US005431295A

United States Patent [19]

Meess

[11] Patent Number: 5,431,295

[45] Date of Patent: Jul. 11, 1995

[54] STORAGE MODULE FOR NUCLEAR WASTE WITH IMPROVED LINER

[75] Inventor: Daniel C. Meess, Murrysville, Pa.

[73] Assignee: Westinghouse Electric Corporation, Pittsburgh, Pa.

[21] Appl. No.: 758,220

[22] Filed: Sep. 12, 1991

Related U.S. Application Data

[63] Continuation of Ser. No. 594,669, Oct. 1, 1990, abandoned, which is a continuation of Ser. No. 331,600, Mar. 31, 1989, abandoned.

[51] Int. Cl.[6] ..... B65D 25/14

[52] U.S. Cl. ..... 220/408; 220/645; 220/455; 250/507.1

[58] Field of Search ..... 220/470, 455, 457, 586, 220/484, 645, 654, 444, 408, 902, DIG. 12, 461, 460, 901; 206/524; 138/172, 149, 121, 114, 113, 175; 250/506.1, 507.1

[56] References Cited

U.S. PATENT DOCUMENTS

| | | | |
|---|---|---|---|
| 3,139,627 | 7/1964 | Rice | 220/470 |
| 3,151,416 | 10/1964 | Eakin et al. | 220/457 |
| 3,363,796 | 1/1968 | Pringle | 220/444 |
| 3,379,221 | 4/1968 | Harry et al. | 138/172 |
| 3,400,849 | 9/1968 | Pottier | 220/444 |
| 3,503,171 | 3/1970 | Frohly | 220/586 |
| 3,599,575 | 8/1971 | Yurkoski | 220/457 |
| 3,753,848 | 8/1973 | Bennett | 220/902 |
| 3,757,982 | 9/1973 | Isenberg | 220/444 |
| 3,863,408 | 2/1975 | Closner et al. | 220/586 |
| 3,882,628 | 5/1975 | Stouder | 220/902 |
| 3,901,406 | 8/1975 | Kivett | 220/72 |
| 3,912,107 | 10/1975 | Baumann | 220/444 |
| 4,015,742 | 4/1977 | Albrecht et al. | 220/586 |
| 4,225,054 | 9/1980 | Jean | 220/902 |
| 4,229,316 | 10/1980 | Baatz et al. | 250/507.1 |
| 4,458,458 | 7/1984 | Orii . | |
| 4,588,088 | 5/1986 | Allen | 206/524 |
| 4,681,706 | 7/1987 | Mallory et al. . | |
| 4,752,437 | 6/1988 | Ito et al. | 250/506.1 |
| 4,777,931 | 10/1988 | Ziegler | 220/DIG. 12 |
| 4,825,687 | 5/1989 | Sharp | 220/444 |
| 4,845,372 | 7/1989 | Mallory et al. | 250/506.1 |
| 4,859,262 | 8/1989 | Sharp | 220/469 |
| 5,060,697 | 10/1991 | Weinheimer | 138/121 |

FOREIGN PATENT DOCUMENTS

| | | | |
|---|---|---|---|
| 37312 | 3/1981 | European Pat. Off. . | |
| 0251045 | 1/1988 | European Pat. Off. | 220/470 |
| 338894 | 10/1989 | European Pat. Off. . | |
| 2716463 | 10/1978 | Germany . | |
| 2833231 | 3/1979 | Germany | 220/586 |
| 2801946 | 7/1979 | Germany | 250/506.1 |
| 2817193 | 10/1979 | Germany | 250/506.1 |
| 2911185 | 10/1980 | Germany | 250/506.1 |
| 3608949 | 9/1987 | Germany | 220/470 |
| 0000696 | 1/1984 | Japan | 220/470 |
| 0270599 | 11/1986 | Japan | 220/444 |
| 2142300 | 6/1987 | Japan | 220/444 |
| 0023066 | 5/1988 | Japan | 220/470 |
| 2125610 | 3/1984 | United Kingdom . | |

*Primary Examiner*—Stephen J. Castellano

[57] ABSTRACT

A module for the storage of nuclear waste packages from a nuclear power plant is disclosed comprising a concrete precast container with sidewalls and a bottom, a concrete precast lid removably disposed on upper edges of the sidewalls to close the container, and a cylindrical one-piece seamless liner abutting and covering the interior surface of the container. The liner is provided with anchor elements formed integral with the liner that extend along outside surfaces of the liner sidewalls and bottom wall, and the anchor elements are embedded within the concrete precast sidewalls on the container. The anchor elements are provided by a plurality of ribs which can be T-shaped or dovetail shaped in cross-sectional area and may extend either longitudinally or circumferentially about the liner. The module is manufactured by first forming a one-piece seamless liner including the ribs on its outer surfaces, placing the liner in a mold for the module, and thereafter pouring concrete into the module mold to completely fill the space between the liner and the mold for embedding the ribs within the concrete. The integrally formed liner provides an additional barrier for nuclear wastes that is advantageously devoid of seams or weld joints. The manufacturing method of the invention insures a perfect, gapless fit between the liner and the concrete module.

19 Claims, 2 Drawing Sheets

STORAGE MODULE FOR NUCLEAR WASTE WITH IMPROVED LINER

This application is a Continuation of Ser. No. 07/594,669, filed Oct. 1, 1990, now abandoned, which was a Continuation of Ser. No. 07/331,600, filed Mar. 31, 1989 now abandoned.

TECHNICAL FIELD

This invention generally relates to a concrete storage module for receiving and storing nuclear wastes of various radiation levels so that the waste may be safely handled by human workers and permanently deposited at a waste repository or disposal site. The invention is specifically concerned with an improved seamless liner that is integrally formed with the concrete module to provide an additional shielding layer and protection against leakage.

BACKGROUND OF THE INVENTION

Systems and storage modules for packaging nuclear waste are known in the prior art. One such known storage module is formed as a precast modular concrete container within which waste packages are placed. The module is about two meters in diameter, which renders it small enough to be handled by a shielded forklift, and has hexagonal walls so that is may be efficiently stacked into a solid array at a disposal site. Typically, the storage module is closed off by a precast concrete lid and the module is then transported to a storage repository or disposal site. An example of a storage facility utilizing such precast storage modules is shown in U.S. Pat. No. 4,681,706 issued Jul. 21, 1987, and owned by the Westinghouse Electric Corporation. The disclosure of U. S. Pat. No. 4,681,706 is expressly incorporated by reference herein.

In the past, a cementitious grout has been poured within the storage module to secure the waste packages in place and also to provide an additional leakage barrier and radiation shield. A granular fill material, which is the subject matter of commonly owned U.S. Pat. No. 4,950,426, entitled "Granular Fill Material for Nuclear Waste Containing Modules" filed March 31, by Joseph M. Markowitz et al. and also assigned to the Westinghouse Electric Corporation is even more preferred for this purpose. For low level and short level radioactive wastes, such additional leakage barrier layers, being either a cementitious grout or granular fill, are normally amply sufficient for most storage purposes.

However, for long-lived radionuclides, high-level radioactive waste, and mixed waste, the additional protection afforded by an impermeable liner placed within the storage module is highly desirable. Radioactive waste can remain as a hazardous material for 200 years or more, depending on the known half lives of the specific radioactive elements. Therefore, it is necessary that the storage containers be sufficiently strong and durable to provide a leak-tight barrier for as many years.

A known liner used for additional protection in the previously described concrete storage module has been manufactured by welding together pieces of an impermeable material along the internal sidewalls of the container. While such a liner is capable of providing a durable leak-tight barrier, it is unfortunately difficult to fabricate and to install. Because of manufacturing tolerances, the inside diameter of the storage modules vary and the sections of the liner to be pieced together also vary. As a result of these variances, it is difficult to obtain a precise fit between the liner and the interior of the concrete module without custom-modifying the dimensions of the liner sections, which is time consuming. The installation of such a liner results in a loss of storage space within a module, even when the fit is perfect. Finally, because the liner includes a number of weld joints, there is a possibility that the welds can fail thus providing a path for liquid waste to leak out of the container.

Another example of a lined concrete container is disclosed in U.S. Pat. No. 4,458,458 issued Jul. 10, 1984 to Orii. In this patent, a concrete tank is lined by plates which are attached to the inside surfaces of the tank. In each of the disclosed embodiments, however, the lining plates are either welded to an embedded member within the concrete walls, or to each other where they abut adjacently. Thus, the same problems associated with welding of a liner, are still present in such a device.

Clearly a need exists for a storage module of precast concrete for storing nuclear wastes that has the additional protection of an impermeable liner placed within it that eliminates the manufacturing problems of fitting the liner into the concrete module, and does not result in the loss of any significant amount of storage space. Ideally, such a liner should not have any welded joints which could fail and provide a leakage path through the container.

SUMMARY OF THE INVENTION

In its broadest sense, the invention is a nuclear waste storage module with a one-piece seamless liner integrally molded with the concrete of the module, thus providing a one-piece integral unit. The seamless liner eliminates the possibility of faulty welds, and the one-piece unit eliminates the problems associated with fitting the liner to the module and does not significantly reduce the storage space in the container.

Particularly, the module includes a concrete precast container having sidewalls and a bottom, a concrete precast lid removably disposed on the upper edges of the side walls for closing the container, and a cylindrical one-piece seamless liner covering the interior surfaces of the container sidewalls and bottom. Further, the liner is provided with an anchor means integrally formed with the liner that extends along the outside surface of its tubular shaped sidewall and bottom portion. The anchor means includes portions which are embedded within the concrete precast side walls and bottom of the container when the container is manufactured. The anchor means may be comprised of ribs having both a first portion that extends away from the outside surface of the liner and a second portion that extends in a perpendicular direction from the outwardly extending portion, whereby both portions effectively secure the liner to the container's sidewalls and bottom when embedded therein. The ribs can extend along the sidewall of the liner in either a longitudinal direction from the bottom to the upper edges, or in a circumferential direction, wherein a number of uniformly spaced unending ribs are provided around the longitudinal axis of the liner. In one embodiment, the ribs are basically T-shaped, wherein a single portion extends outward while two portions extend perpendicularly thereto. Another embodiment has a dovetail shape in cross-section which can be basically divided into a outwardly extending portion with wedge shaped portions on either side that increase in size away from the liner. A liner lid can optionally be provided which can be fitted atop the upper edges of the liner to seal off the cylindrical interior of the liner after it is filled with a waste package and other barrier material. The liner is preferably molded from a plastic such as a polymer of the type having a relatively long, useful life. Examples include high density cross-linked polyethylene, low density polyethylene and vinyl ether resins. Additionally, the resins can be reinforced with fibers such as fiberglass material.

The storage module and integral liner is manufactured by forming the one-piece seamless liner in a tubular shape with a flat, floor-like bottom portion, with the ribs integrally formed thereon along the sides and bottom. Thereafter, the one-piece liner is placed in a storage module mold and is supported therein to mold the concrete inner walls of the module and the the inner surface thereof. When, concrete is poured into the module mold and the mold space is completely filled, the ribs of the liner are embedded in the concrete. When the concrete sets, an integral module unit and liner are formed.

DETAILED DESCRIPTION OF PREFERRED EMBODIMENTS

Figure 1:
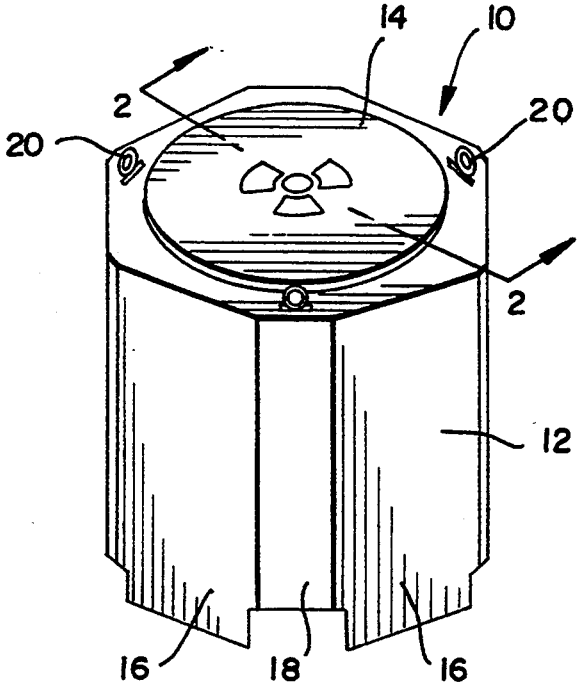
FIG. 1 is a perspective view of a closed module in accordance with the present invention.

With reference now to FIG. 1, wherein like reference numerals designate like components throughout all of the several figures, a storage module 10 will be described. The storage module 10 is comprised of a container 12 and a lid 14 to removably seal off the interior of the container 12. The container 12 includes substantially flat sidewalls 16 separated by short corner walls 18. The sidewalls 16 are integrally formed with a bottom 17. The sidewalls 16 facilitate the side-by-side placement of plurality of such modules in a storage repository or disposal site, and the corner walls 18 form small gaps between adjacent modules 10 that permit access for hoisting tools to grasp a single storage module 10 when they are packed in an array and stacked on top of one another. Eye hooks 20, of which three are shown in FIG. 1, are also provided to facilitate hoisting and moving the modules 10.

Figure 2:
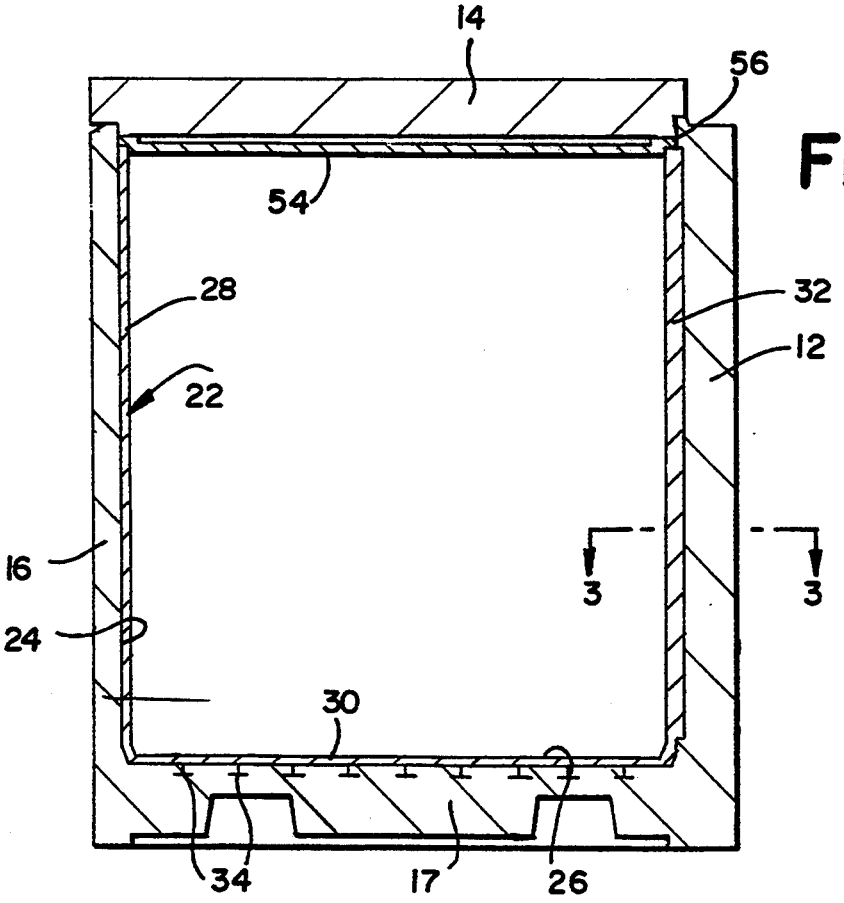
FIG. 2 is a cross-sectional view of the module of FIG. 1 taken along line 2—2.

With reference now to FIG. 2, a one-piece seamless liner 22 is provided in contact with the interior surfaces of the sidewalls 16 at 24 and the bottom 17 at 26. The liner 22, for the purposes of explanation, is divided into a tubular sidewall portion 28 and a bottom portion 30. Integrally molded with the liner 22 are a plurality of ribs 32 on the sidewall portion 28 which extend in the longitudinal direction of the container 12 (from the bottom 17 to the upper edges of sidewalls 16). The ribs 32 are circumferentially spaced along the tubular sidewall 28 of liner 22 at intervals, which may be regular or not as desired. Preferably the ribs are regularly spaced at an interval of between six and twelve inches along the circumference. It is understood that the more frequent the interval up to a degree, the greater number of ribs for anchoring the liner to the container 12 and the stronger the liner 22 is secured. However, it is noted that at some point the amount will become too many and will result in a weaker area of concrete between the ribs. Likewise, ribs 34 on the bottom portion 30 extend along the substantially flat bottom 30 wherein the direction of extension of the ribs 34 is not of particular importance.

Figure 3:
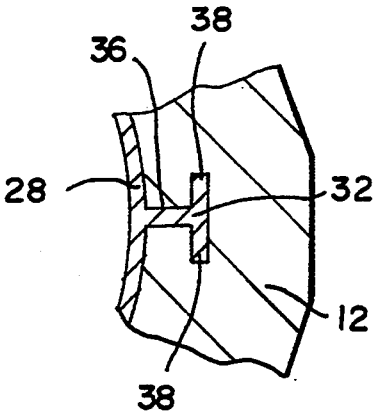
FIG. 3 is a partial cross-section taken along line 3—3 of FIG. 2, illustrating one embodiment of a longitudinal rib formed in accordance with the present invention.

As can be seen by the ribs 34 on the bottom portion 30 of FIG. 2 and in the partial cross-section of FIG. 3 illustrating side ribs 32, each of the ribs is substantially T-shaped in cross-section in one preferred embodiment. Each rib 32 includes an outwardly extending or radially extending portion 36 with two leg portions 38 extending substantially perpendicularly to outward portion 36. The outwardly extending portion 36 ensures that the ribs are embedded deep enough within the concrete sidewalls 16 of the precast container 12 while the perpendicular portions 38 make sure that the ribs 32 and the liner 22 itself is securely held within the concrete sidewalls 16. The ribs 34 on the bottom portion 30 are similarly formed as the ribs 32 with an outwardly extending portion 36 and perpendicular leg portions 38.

Figure 4:
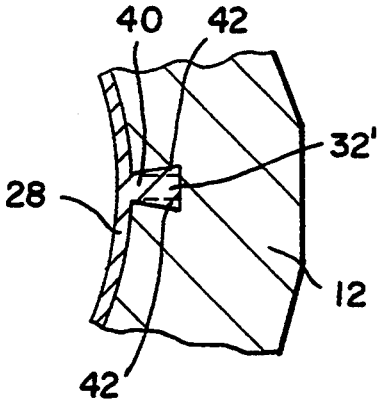
FIG. 4 is a partial cross-sectional view taken along line 3—3 of FIG. 2, illustrating a second embodiment of a longitudinal rib of the present invention.

In FIG. 4, a second embodiment of the sidewall ribs is shown and designated as 32'. The rib 32' functions similarly as the T-shaped rib 32 previously described. An outwardly extending portion 40 is defined, for the purposes of explanation, with perpendicular portions 42 on both sides thereof, wherein each perpendicular portion 42 is basically wedge-shaped in cross-section to define a dovetail-type rib cross-section that increases in size away from the liner sidewall 28. This dovetail rib 32' functions to adequately space the rib deep enough within the concrete sidewall of the container 12 as well as to permanently secure the liner 22 to the container 12 in a reliable and effective manner.

Figure 5:
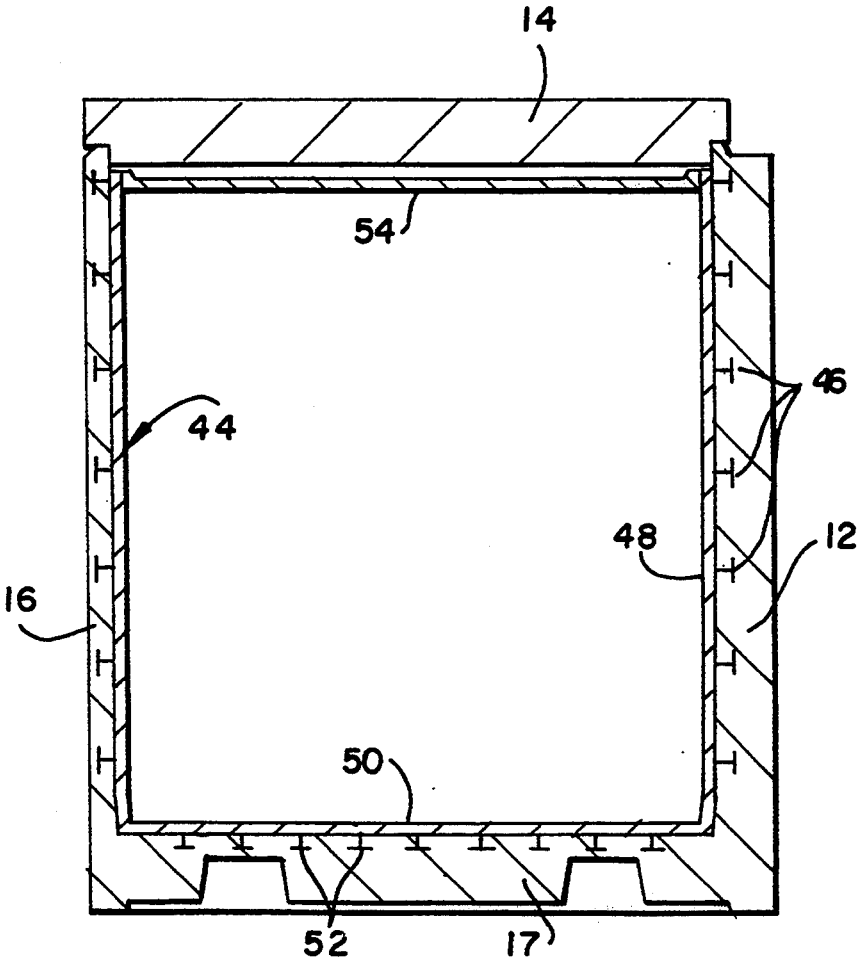
FIG. 5 is cross-sectional view taken along line 2—2 of FIG. 1, which is similar FIG. 2 but illustrates modified circumferential ribs in accordance with the invention.

In FIG. 5, the module 10 is illustrated which is basically similar to that shown in FIG. 2. However, a modified liner 44 is provided wherein ribs 46 are circumferentially extended along the tubular sidewall portion 48. The circumferential ribs 46 are longitudinally spaced along the sidewall portion 48, thus defining a plurality of never-ending ribs from the bottom to the top of container 12. Likewise, the circumferential ribs 46 can be regularly spaced or not as desired and as deemed necessary for an effective and proper securement of the modified liner 44 to the container 12. A bottom portion 50 is also provided with ribs 52 extending along the substantially flat outer surface of the bottom portion 50, wherein as above the direction of extension is not of particular importance. Furthermore, the circumferential ribs 46 and the bottom ribs 52 can be formed with a T-shaped cross-section, as illustrated in FIG. 3, or with a dovetail shaped cross-section, as in FIG. 4.

It is understood that the ribs can be formed with essentially any cross-sectional shape in accordance with the present invention. However, it is preferred that the ribs be provided with an outwardly extending portion and at least one other portion with a component perpendicular to or at least traversive of the outwardly extending portion. Thus, curved surfaces are contemplated as well as multiple numbers of outwardly extending portions and perpendicular portions which would define a tree-type anchoring means. The basic function of all of these anchoring means is that the ribs are spaced to a desirable depth within the concrete sidewalls of the container 12 for the perpendicular portions to lock the liner to the container 12.

Optionally, a liner cover 54 can be provided, which would be disposed beneath the precast concrete lid 14 and sealingly connected to the upper most edges of the liners 22 or 44. In order to assist the sealing engagement between the liner cover 54 and a liner 22, recesses 56 can be provided at the peripheral edge of the cover liner 54, as seen in FIG. 2. The cover liner is utilized after a waste package is provided within the module 10 for storage of a permanent nature, where after the cover liner 54 is sealed to the liner by way of a seal weld, adhesive bond, or other conventional technique. Preferably, the cover liner 54 is formed of the same or similar material as that of which the liner 22 is composed.

In order to manufacturer the storage module 10 with an integral one-piece seamless liner 22, as in FIG. 2, it is necessary to first form the liner 22. The liner 22 is formed as a single seamless piece with integral ribs 32 and 34 on the outside surface thereof by molding the entire piece. One such molding technique contemplated is to form the liner by injection molding wherein the desired polymer, blend of polymers, or composites is injected into a shaped mold in molten state. It is understood that any other conventional molding techniques can be utilized as well.

After the liner 22 is formed, the liner 22 is placed within a module mold. The module mold (not shown) is simply defined by an opening which corresponds to the external shape of the module 10, as in FIG. 1, defining the outer surfaces of the sidewalls 16, 18, and the bottom 17. The liner 22 is supported within the module mold so as to define a mold space between the liner 22 and the module mold into which concrete will be poured. The liner 22 can be supported by rigid elements placed within the interior of the mold space to hold the liner 22 in place from the bottom and/or sides, or can be suspended from above by a jig that grips the upper edges of the liner 22 at a plurality of locations to hold the liner in place. Thereafter, the concrete is poured within the mold space and the liner 22 becomes the interior surface of the finished module 10. This manufacturing method advantageously allows the liner to be permanently affixed to the container 12 without regard to the manufacturing tolerances and slight alignment inaccuracies when supporting the liner 22 with respect to a module mold. The concrete will simply flow completely around and fill the mold space and will lock the liner to the container 12 by way of the anchoring means such as the ribs 32 and 34. After the concrete is poured and the concrete sets, the module is then removed from the module mold, thereby providing a one-piece integral unit.

Preferably, the module 10 is manufactured so that the sidewalls 16 are at their smallest dimension at least three inches in thickness for shielding purposes, while it is evident that the corner wall portions 18 would be substantially thicker. Likewise, the mold is of a sufficiently large size to accommodate many different types of nuclear waste packages, including barrels, boxes and other larger containers. The liner itself is preferably $\frac{1}{8}$ to $\frac{1}{4}$ of an inch in thickness and the ribs extend between $\frac{3}{4}$ of an inch and 1 inch into the concrete sidewalls.

I claim:

1. A transportable module for the storage of nuclear waste packages therein, comprising a container made from a moldable material and having sidewalls and a bottom that define an interior space, and a one-piece seamless lining means formed from a material for both lining the interior of said container to provide a leak-tight barrier against radioactive wastes contained within said module and for providing an inner mold element for said moldable material to form said sidewalls and said bottom when said container is fabricated to thus provide close contact between said lining means and the interior surfaces of said sidewalls and said bottom of said container, said lining means including anchor means for securing said lining means to said container, said anchor means being integrally molded with said lining means to extend along the outside of the walls of said lining means, wherein said anchor means is at least partially embedded within the sidewalls of said container.

2. The module of claim 1, wherein said anchor means is comprised of ribs, each of said ribs having a radially extending portion, as defined by the direction radially from an axis line central of the walls of said lining means and at least one portion extending perpendicular to said radially extending portion, said radially extending portion of each rib defines the extent to which the ribs are embedded within said container and said at least one perpendicular portion of each rib is fully embedded within said container.

3. The module of claim 2, wherein said ribs extend along said sidewalls in a longitudinal direction of said container from said bottom to its upper edges.

4. The module of claim 2, wherein said lining means is cylindrical and said ribs extend circumferentially along the outside of the walls of the lining means, thereby defining a plurality of annular ribs spaced along a longitudinal direction of said container.

5. The module of claim 2, wherein said anchor means also includes ribs that extend along an outside surface of the bottom of said lining means and are at least partially embedded within the bottom of said container, said bottom ribs each having a portion extending in an axial direction of said interior space of said lining means and at least one portion extending perpendicular thereto.

6. The module of claim 2, wherein each of said ribs in cross-section is T-shaped, thus defining, one radial portion and two portions perpendicular thereto.

7. The module of claim 2, wherein each of said ribs in cross-section has one radial portion and a wedge-shaped portion on both sides of said radial portion, thereby defining a dovetail rib with increasing size away from said lining means.

8. The module of claim 1, further including a lid liner provided at upper edges of said one-piece seamless lining means to close off the interior of said one-piece seamless lining means.

9. The module of claim 1, wherein said lining means is made of high-density, cross-linked polyethylene.

10. A transportable module for the storage of nuclear waste packages therein, comprising a container made from a moldable material with sidewalls and a bottom, a lid removable disposed on upper edges of said sidewalls, said sidewalls and said bottom having interior surfaces defining an interior space, and a one-piece, seamless lining means formed from a material both for lining the interior of said container to provide a leak-tight barrier against radioactive wastes contained within said module and for providing an inner mold element for said moldable material to form said sidewalls and said bottom when said container is fabricated and to thus provide close contact between said lining means and said interior surfaces of said sidewalls and said bottom, wherein said lining means includes anchor means for securing said lining means to said container, said anchor means being integrally molded with said lining means to extend along the outer surfaces of a wall and a bottom portion of said liner, said anchor means comprising at least one rib, each rib having a portion that extends outward from said liner and at least one portion that extends perpendicular to said outwardly extending portion, and said outwardly extending portion and said perpendicular portion being embedded within the sidewalls and bottom of said container, said outwardly extending portion of each rib defining the extent to which the rib is embedded within said container and said at least one perpendicular portion of each rib being fully embedded within said container.

11. The module of claim 10, wherein said anchor means includes a plurality of ribs which extend along said wall and bottom portion of said lining means in a longitudinal direction of said container from said bottom to said upper edges.

12. The module of claim 10, wherein said lining means is cylindrical and said anchor means includes a plurality of ribs which extend circumferentially along said wall and bottom portion of said lining means, thereby defining a plurality of annular ribs spaced along a longitudinal direction of said container.

13. The module of claim 11, wherein said lining means is cylindrical and each of said plurality of said ribs in cross-section is T-shaped, thus defining one radial portion and two portions perpendicular thereto.

14. The module of claim 12, wherein each of said plurality of said ribs in cross-section is T-shaped, thus defining one radial portion and two portions perpendicular thereto.

15. The module of claim 11, wherein said lining means is cylindrical and each of said plurality of said ribs in cross-section has one radial portion and a wedge-shaped portion on both sides of said radial portion, thereby defining a dovetail rib with increasing size away from said lining means.

16. The module of claim 12, wherein each of said plurality of said ribs in cross-section has one radial portion and a wedge-shaped portion on both sides of said radial portion, thereby defining a dovetail rib with increasing size away from said lining means.

17. The module of claim 10, further including a lid lining means provided at upper edges of said one-piece seamless lining means to close off the interior of said one-piece seamless lining means.

18. The module of claim 10, wherein said lining means is made of high-density, cross-linked polyethylene.

19. A transportable module for the storage of nuclear waste packages therein, comprising a container made from a moldable material and having sidewalls and a bottom that define an interior space, and a one-piece seamless lining meads formed from a material and having walls and a bottom portion integrally molded with said moldable material to form said sidewalls and said bottom when said container is fabricated to thus provide close contact between said lining means and the interior surfaces of said sidewalls and said bottom of said container, said lining means including anchor means for securing said lining means to said container, said anchor means integrally molded with said lining means to extend along the outside of the walls of said lining means, wherein said anchor means is embedded within the sidewalls of said container.

* * * * *